US009260833B2

(12) United States Patent
Huissoon

(10) Patent No.: US 9,260,833 B2
(45) Date of Patent: Feb. 16, 2016

(54) ARTICULATED OPERATING ARM WITH MECHANICAL LOCKING BETWEEN ARM SECTIONS

(75) Inventor: Leendert Wilhelmus Cornelis Huissoon, Kruiningen (NL)

(73) Assignee: Hudson Bay Holding B.V., Kruiningen (NL)

( * ) Notice: Subject to any disclaimer, the term of this patent is extended or adjusted under 35 U.S.C. 154(b) by 485 days.

(21) Appl. No.: 13/700,994

(22) PCT Filed: May 31, 2011

(86) PCT No.: PCT/NL2011/000042

§ 371 (c)(1),
(2), (4) Date: Jan. 9, 2013

(87) PCT Pub. No.: WO2011/152708

PCT Pub. Date: Dec. 8, 2011

(65) Prior Publication Data

US 2013/0108405 A1 May 2, 2013

(30) Foreign Application Priority Data

May 31, 2010 (NL) ..... 2004784

(51) Int. Cl.

| | |
|---|---|
| ***E02F 3/38*** | (2006.01) |
| ***E02F 3/30*** | (2006.01) |
| ***E02F 3/96*** | (2006.01) |
| ***B66B 13/14*** | (2006.01) |

(Continued)

(52) U.S. Cl.

CPC . *E02F 3/30* (2013.01); *B66B 13/14* (2013.01); *B66C 23/54* (2013.01); *E02F 3/301* (2013.01); *E02F 3/388* (2013.01); *E02F 3/961* (2013.01); *E02F 9/006* (2013.01); *E02F 9/2275* (2013.01); *B63B 27/04* (2013.01)

(58) Field of Classification Search

CPC ..... E02F 3/388; E02F 3/961; E02F 3/3609; E02F 3/30; E02F 3/964

See application file for complete search history.

(56) References Cited

U.S. PATENT DOCUMENTS 4,978,243 A * 12/1990 Hensler ..... B66F 11/044 182/2.9
5,609,261 A * 3/1997 Hensler ..... E02F 3/388 212/292

(Continued)

FOREIGN PATENT DOCUMENTS

DE 3106268 A1 * 9/1982 ..... E02F 3/30
EP 1472416 A2 11/2004

(Continued)

*Primary Examiner* — Gerald McClain

(74) *Attorney, Agent, or Firm* — Bret E. Field; Bozicevic, Field & Francis LLP

(57) ABSTRACT

Articulated operating arm (100) on which one or more implements are or can be mounted, comprising substantially three articulations (101,102,103) which are pivotally connected to each other, which substantially three articulations comprise a first articulation, a second articulation and a third articulation which is intended for connection to the one or more implements, which second articulation is pivotally connected at a first end to the first articulation an at a second end to the third articulation, wherein the substantially three articulations are rotatable adjacently of each other in order to form a shortened arm, this such that during the rotation a mechanical locking of the third articulation occurs between the second and the first articulations.

10 Claims, 6 Drawing Sheets

(51) Int. Cl.

| | |
|---|---|
| ***B66C 23/00*** | (2006.01) |
| ***E02F 9/00*** | (2006.01) |
| ***E02F 9/22*** | (2006.01) |
| *B63B 27/04* | (2006.01) |

(56) References Cited

U.S. PATENT DOCUMENTS

| | | | | |
|---|---|---|---|---|
| 7,287,949 | B2 * | 10/2007 | Huissoon | E02F 3/301 414/685 |
| 2002/0062587 | A1 | 5/2002 | Kimoto et al. | |
| 2005/0169738 | A1 | 8/2005 | Holt | |

FOREIGN PATENT DOCUMENTS

| | | | |
|---|---|---|---|
| EP | 1472416 | B1 | 9/2006 |
| JP | 6220879 | A | 8/1994 |
| JP | 10037240 | A | 2/1998 |
| JP | 2009007760 | A | 1/2009 |
| NL | 1035694 | C2 | 1/2010 |
| WO | WO 2010008277 | A1 | 1/2010 |

* cited by examiner

ARTICULATED OPERATING ARM WITH MECHANICAL LOCKING BETWEEN ARM SECTIONS

The present invention relates to an articulated operating arm on which one or more implements are or can be mounted, comprising a number of articulations which are pivotally connected to each other; a number of control members for controlling the movements of the number of articulations; and a set of conduits for powering the number of control members and, if necessary, the one or more implements.

Such articulated operating arms are generally known and are used in numerous construction machines such as excavators, tractors with operating arms, but also in articulated operating arms for other applications, such as on ships and the like.

US 2002/0062587 A1 describes the use of swivel joints of a symmetrically embodied articulated operating arm with two articulations for an excavator.

Another possible embodiment of an operating arm is described in detail in the European patent EP 1 472 416 and in NL 1035694, both in the name of applicant, the texts of which are incorporated here by reference.

The invention has for its object to improve such an operating arm, particularly in respect of the conduits in/on the different articulations of the operating arm.

The invention is distinguished for this purpose in that a preceding articulation and a subsequent articulation of at least three articulations present in the articulated operating arm are connected by means of a substantially hollow shaft through which at least one of the number of conduits runs. An advantage of training at least one conduit through a hollow connecting shaft is that the conduits are less visible, less exposed to damage, can in some cases also be shorter and can be arranged and guided more efficiently through the articulated operating arm.

Reference will be made in the description to the different articulations as "first", "second", "third", "last", "preceding", "subsequent" articulations. The first articulation refers to the articulation which is adapted to be connected to a chassis of a machine, for instance an excavator, while the last articulation refers to the articulation adapted for mounting on one or more implements. One or more articulations connected pivotally and successively to each other can be present between the first and last articulations. The terms "preceding" and "subsequent" always refer here to two successive articulations, numbering from the first articulation to the last articulation.

In preferred embodiments of the present invention the first articulation is adapted for coupling to a chassis and the last articulation is adapted for coupling to an implement, and the subsequent articulation is one of the articulations differing from the last articulation. In other words, the hollow shaft is arranged between two successive articulations, wherein the two successive articulations do not comprise the last and penultimate articulations.

It is often the case that the angular displacement around a rotation point between successive articulations is quite large. This is particularly the case between the first and second articulations, and still more the case when the operating arm comprises substantially three articulations, because the angular displacement is large (in the order of angle a>100° up to for instance a=140°, 150°, 160°, 170°, 180°), which makes the use of standard conduits and hoses difficult.

In preferred embodiments of the present invention the preceding and subsequent articulations correspond to the first and the second articulations.

In embodiments of the present invention the at least one conduit comprises a swivel joint mechanism. By making use of a swivel joint or swivel joint mechanism, conduits associated with the first and second articulations can be spared the undesirable effects resulting from not being able to fold the respective conduits compactly enough and resulting from the limited flexibility of conduits available for such applications. In the prior art the conduits between a preceding and a subsequent articulation (for instance the first and the second) are embodied such that they should be able to accommodate the whole angular displacement between the articulations, although the angular displacement is usually limited to angles a of less than 100°. In the case of an operating arm which can be shortened by folding the articulations together, particularly by having them rotate toward each other and against each other, this angular range is much greater, and possibly problematic. The presence of a swivel joint mechanism allows the displacement to be accommodated to be reduced, accommodated better or distributed better among incoming and outgoing conduits, in accordance with the specific embodiment of this feature.

The swivel joint mechanism can in principle be arranged at different locations.

According to preferred embodiments of the present invention the swivel joint mechanism for the at least one conduit is housed in the hollow shaft. This has the advantage that the swivel joint mechanism is visible to limited extent and is integrated compactly and elegantly with the articulated operating arm.

In preferred embodiments the preceding and the subsequent articulation (for instance the first and the second) are arranged mutually adjacently along the hollow shaft. The preceding and the subsequent articulation can pivot around this hollow shaft. In such configurations, which in some embodiments correspond to embodiments of the European patent no. 1 472 416, the problems of the limited flexibility and large possible displacement which has to be accommodated by the conduits are even more pronounced. According to preferred embodiments of the present invention the swivel joint mechanism is arranged so as to rotate partially on the side of the preceding articulation and to rotate partially on the side of the subsequent articulation.

In preferred embodiments the swivel joint mechanism is arranged at the position of the preceding articulation (for instance the first articulation). In preferred embodiments the swivel joint mechanism is adapted to rotate freely adjacently of the preceding articulation (for instance the first articulation).

In preferred embodiments the swivel joint mechanism is arranged at the position of the subsequent articulation (for instance the second articulation). In preferred embodiments the swivel joint mechanism is adapted to rotate freely adjacently of the subsequent articulation (for instance the second articulation).

In preferred embodiments of the present invention the swivel joint mechanism is arranged or suspended such that substantially no physical forces are exerted on the swivel joint mechanism during use of the arm.

In a further preferred embodiments of the present invention one or more protective parts are present to protect the one or more swivel joints and their one or more associated conduits.

These protective parts for the swivel joint mechanism or the passage and their associated conduit(s) can be mounted on one or more articulations and/or the hollow shaft between the preceding and subsequent articulation.

In preferred embodiments the one or more protective part(s) is/are provided on its/their underside with channels for guiding at least one conduit.

Described in preferred embodiments is an articulated operating arm in which the hollow shaft comprises at its respective outer ends couplings which are adapted for coupling to conduits and in which the hollow shaft is further adapted to internally connect to each other predetermined pairs of couplings present on opposite outer ends of the hollow shaft.

In preferred embodiments of the present invention an articulated operating arm is described which comprises substantially three articulations which can be rotated adjacently of each other so as to thus enable forming of a shortened arm similar to the operating arm as described in the European application EP 1 472 416 of applicant, which is further arranged and adapted in accordance with the above stated aspects of the present invention. The operating arm improved by means of the above stated aspects, but also the original operating arm described in EP 1 472 416, can also be further improved by adapting the articulations such that during a rotation wherein the substantially three articulations are rotated adjacently of each other a mechanical locking of the third articulation occurs between the second and the first articulation.

Such a mechanical locking provides for a fixation of the third articulation relative to the first and second articulations.

In preferred embodiments of the present invention the one or more implements are or can be mounted on the third articulation, and the third articulation of the operating arm has a greater length than the second, such that when the third, second, first articulations are folded against each other as described in EP 1 472 416 a single operating arm can be realized and the attached implement can be freely used at the free end of the third articulation.

The mechanical locking can be embodied in different ways, as will be appreciated by the skilled person.

In preferred embodiments of the present invention the third and the second articulation each respectively comprise a coupling means, which are arranged such that when the third and second articulations rotate against or adjacently of each other a mechanical locking of the third articulation relative to the second articulation occurs by coupling between the coupling means of the third articulation and the coupling means of the second articulation. In preferred embodiments the first articulation further comprises a coupling means which is arranged for the purpose, after further rotation of the second articulation together with the third articulation (see the previous step) to the first articulation, of coupling to the coupling means of the third articulation.

In preferred embodiments the coupling means of the first articulation comprise recesses which are preferably tapering. The coupling means of the second articulation can preferably also comprise recesses which are tapering. The coupling means of the third articulation can further comprise one or more pin structures. The tapering recesses of the coupling means of the first and the second articulation are preferably adapted to receive the one or more pin structures.

In preferred embodiments the articulated operating arm further comprises an adjusting means for adjusting the mechanical locking of the third, second and first articulations. Such an adjustment can be important in adjusting or guaranteeing the operation of the operating arm after some form of wear or disruption has taken place.

In preferred embodiments the operating arm is arranged and/or adapted such that an automatic adjustment of the locking of the third articulation occurs relative to the second and/or first articulation. This is possible by making use of resilient materials or units, for instance manufactured from rubber, or by incorporating a for instance steel spring in the coupling means of the second and/or first articulation. The coupling means of the first and second articulations, for instance recesses, can be embodied wholly or partially in an elastic material such as rubber or plastic. The coupling means of the first and second articulations can also be spring-mounted by means of for instance one or more for instance steel springs.

In preferred embodiments of the present invention the control members are hydraulic, gas-based (for instance pneumatic) or electrical control members, and the conduits are respectively hydraulic, gas-based (for instance pneumatic) or electrical conduits. A combination of control members of these different types and corresponding conduits is also possible.

FIG. 1A illustrates a 3-D view, while FIG. 1B illustrates a bottom view, FIG. 1C a top view and FIG. 1D a side view of the same device.

FIG. 3 also illustrates the principle of the protective parts for these swivel joint mechanisms.

Figure 1A:
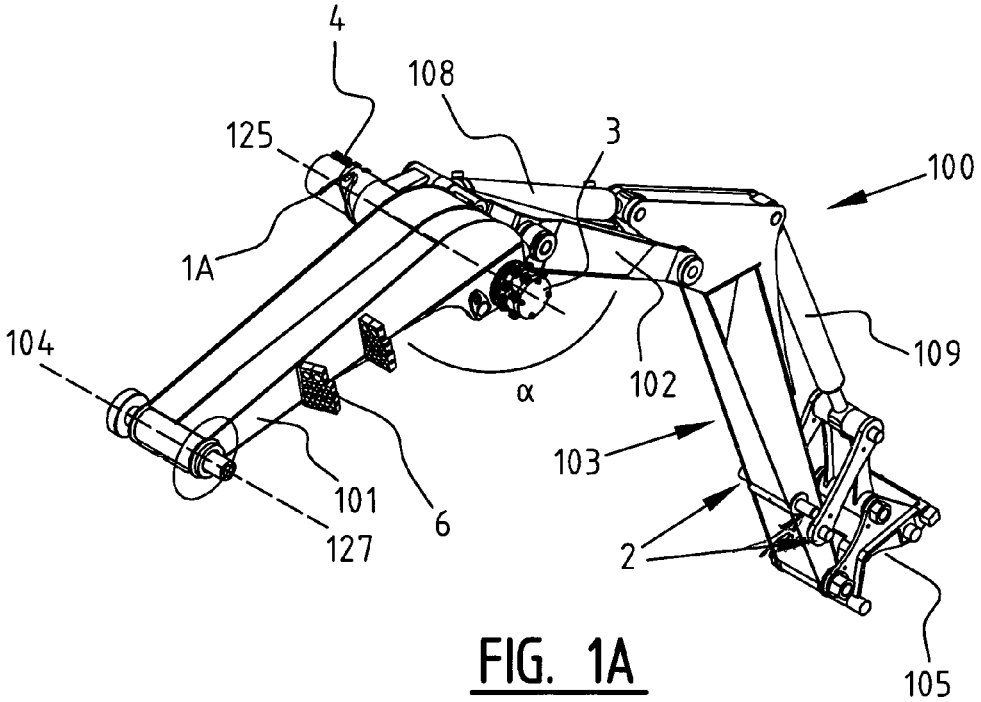
FIGS. 1A-1D illustrate different views of an embodiment of the present invention.

FIGS. 1A-1D show a possible embodiment of an articulated operating arm according to the invention. Such an operating arm is typically intended for use in a construction machine such as an excavator, a tractor with articulated operating arm and the like. In the shown embodiment the articulated operating arm comprises three articulations: a first articulation 101, a second articulation 102 and a third articulation 103. The outer end of first articulation 101 is provided with means 104 for attachment to a chassis of for instance an excavator. The outer end of third articulation 103 is provided in the shown embodiment with a quick change system 105 on which an implement can be mounted. The skilled person will appreciate that numerous other coupling systems are possible for mounting an implement.

Articulations 101, 102, 103 are connected pivotally to each other: second articulation 102 is pivotally connected to first articulation 101 via a pivoting connection to a pivot shaft 125; third articulation 103 is pivotally connected to second articulation 102 via a pivoting connection to pivot shaft 126. In the shown embodiment the articulated operating arm can be connected to a chassis, wherein the connection is such that the articulated operating arm can pivot around a lying shaft 127. Connections with more or fewer degrees of freedom are of course also possible, depending on the chassis and the application for which the operating arm is intended.

Control of the movements of articulations 101, 102, 103 takes place on the basis of control members, here in the form of cylinders 107, 108, 109. Cylinder 107 controls the movement of the second articulation relative to the first articulation; cylinder 108 controls the movement of the third articulation relative to the second articulation; and cylinder 109 controls the movement of a parallelogram linkage 129, and thus the movement of the implement coupled to quick change system 105. The skilled person will once again appreciate that many variants are possible and that the control members do not necessarily have to be provided between adjacent articulations, but can also be provided between non-adjacent articulations. The skilled person will further appreciate that the articulated operating arm can be embodied according to a variant with more than three articulations.

The control members are typically hydraulic cylinders, although according to a variant the control members can also be mechanical, electromagnetic or a combination of mechanical, electromagnetic and hydraulic control members. Such control members must be provided with energy, typically a fluid under pressure, by means of conduits. For the shown embodiment the control members are hydraulic cylinders and the conduits are hydraulic hoses.

Figure 1B:
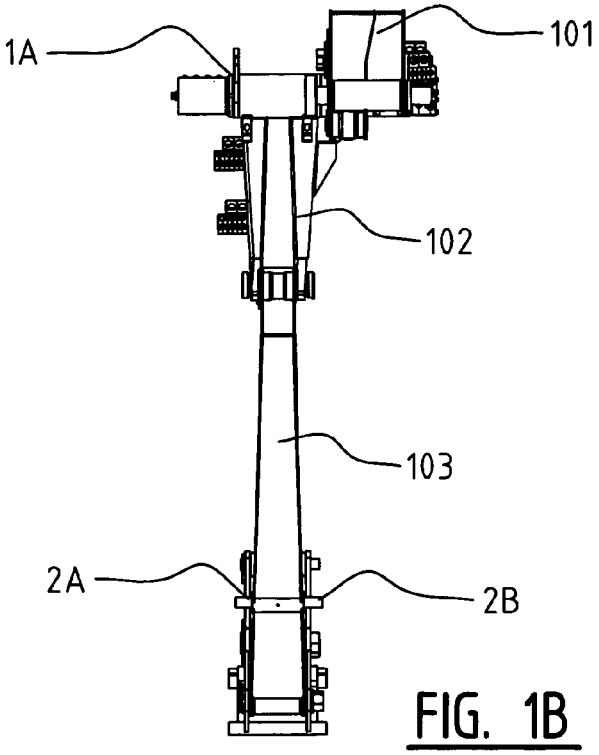
Figure 1C:
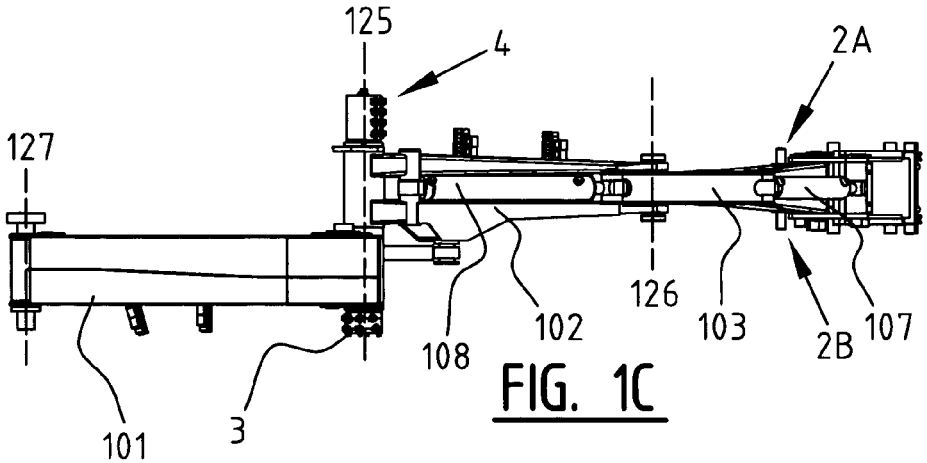
Figure 1D:
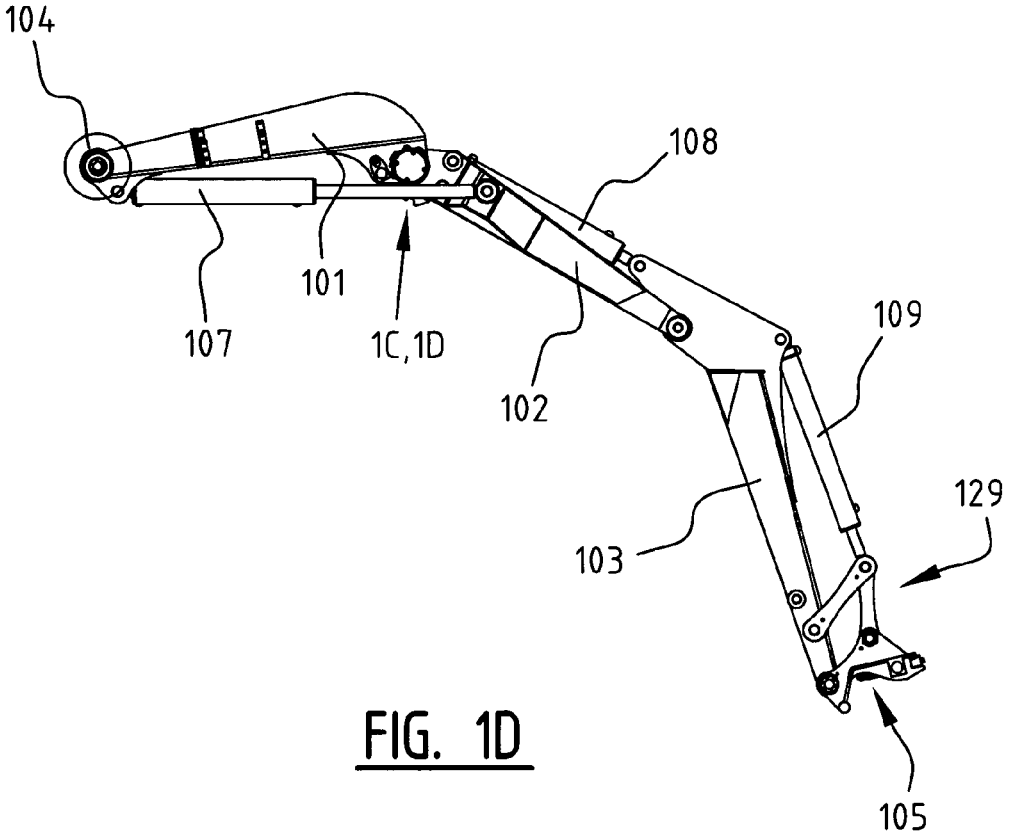

The shown operating arm is of the foldable type: third articulation 103 can here rotate round shaft 126 toward second articulation 102 until they come to lie adjacently and/or against each other. The third and the second articulation together can then be further rotated around shaft 125, defined by the hinge between first articulation 101 and second articulation 102, through an angle a so as to thus come to lie adjacently of first articulation 101 in a shortened arm configuration. Note that with the above described rotation movements the quick change system 105 once again comes to lie at the free outer ends of the operating arm. FIGS. 1A-1D further illustrate the aspects of the mechanical locking of the third articulation relative to the first and second articulations by means of coupling devices 1C and 1D on second articulation 102 and coupling means 1A and 1B (not shown) on the first articulation, which can receive coupling means 2 of the third articulation or can couple thereto when the operating arm is folded together. FIGS. 1A-1B further illustrate the aspect of the present invention in which a swivel joint mechanism (3, 4) is arranged in the hollow shaft which pivotally connects first articulation 101 to second articulation 102.

Figure 2A:
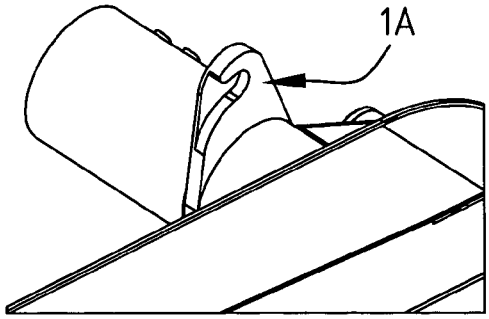
FIGS. 2A and 2B illustrate the aspect of the mechanical locking mechanism relative to the first and second articulations according to aspects of the present invention.
Figure 2B:
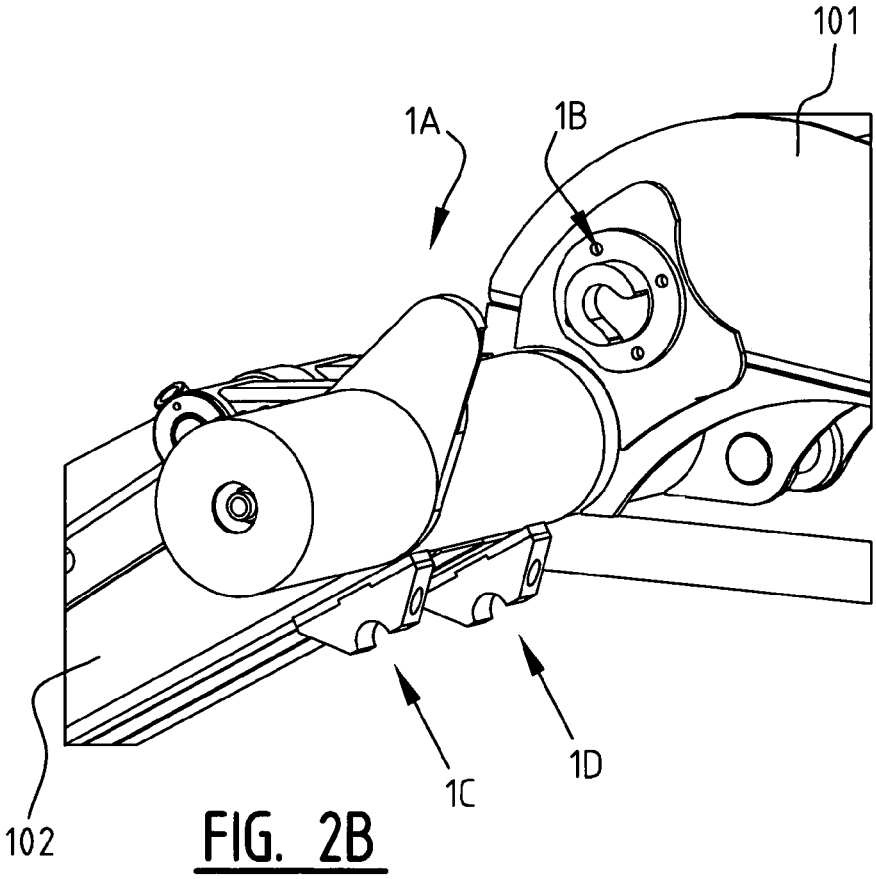

FIGS. 2A and 2B illustrate in detail the mechanical locking mechanism for third articulation 103 relative to the first and second articulations. Third articulation 103 comprises a coupling device 2 which can for instance comprise one or more pins 2A and 2B. When third articulation 103 is rotated around shaft 126 toward and against second articulation 102, these pins 2A and 2B are preferably received in tapering recesses 1C and 1D which are arranged at a suitable position along second articulation 102. When the third and second articulations rotate further around shaft 125 in their folded position toward and against articulation 101, pins 2A and 2B are further received by recesses 1A and 1B arranged at a suitable location on the first articulation. In this way pins 2A and 2B are mechanically locked by recesses 1A and 1B, 1C and 1D. Such a locking requires no activation via hydraulics and/or electronics, whereby it can take a simpler and less expensive form and is moreover safer, since the locking mechanism has no need of pressure or electricity.

Recesses 1A, 1B, 1C and 1D can be embodied partially from an elastic material such as for instance rubber or plastic. 1A, 1B and/or 1C, 1D can also be spring-mounted by means of one or more for instance steel springs.

Figure 3:
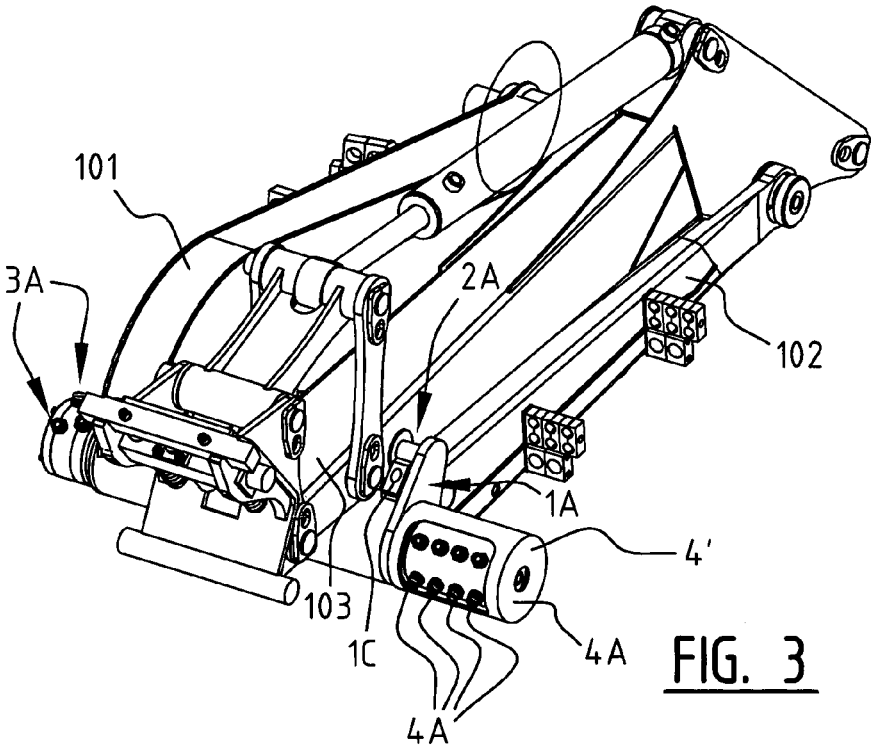
FIG. 3 illustrates embodiments of the present invention, wherein a swivel joint mechanism is arranged in a substantially hollow shaft which functions as pivot shaft between the first and the second articulation.

The locking mechanism is further elucidated in FIG. 3, wherein recesses 1A and 1C mechanically lock pin 2A in a folded-together position of the operating arm. The same occurs (not shown) for pin 2B, which is mechanically locked by recesses 1B and 1D on the other side of the operating arm. FIG. 3 further shows a connection between the first articulation and the second articulation, which comprises a substantially hollow shaft and in which a swivel joint (3, 4) is further arranged. The skilled person will appreciate that different variants of swivel joints and swivel joint mechanisms exist and can be applied. Several embodiments are outlined below. FIG. 3 shows a swivel joint which comprises at one outer end different coupling means for conduits 4A which are connected in predetermined manner to similar coupling means of conduits 3A close to the opposite outer end of the hollow shaft at the opposite outer end 3 of the swivel joint (3, 4). As a result conduits can comprise channels at the swivel joint. In other words, a first conduit part can be coupled to coupling means 4A on the one hand, while another conduit part can be coupled to coupling means 3A on the other in a manner such that the swivel joint provides for a continuity of the conduit comprising the two conduit parts in predetermined manner. The advantage of such a construction is that the conduits which should normally be able to accommodate a full rotation of the operating arm must now be able to do so to only a limited extent or in a better balanced manner. This is the case because part of the compensation of the rotation of the different articulations can be accommodated by the swivel joint. FIG. 3 further illustrates the aspect of a protective cover 4' which can protect the swivel joint and associated conduit(s).

Figure 4:
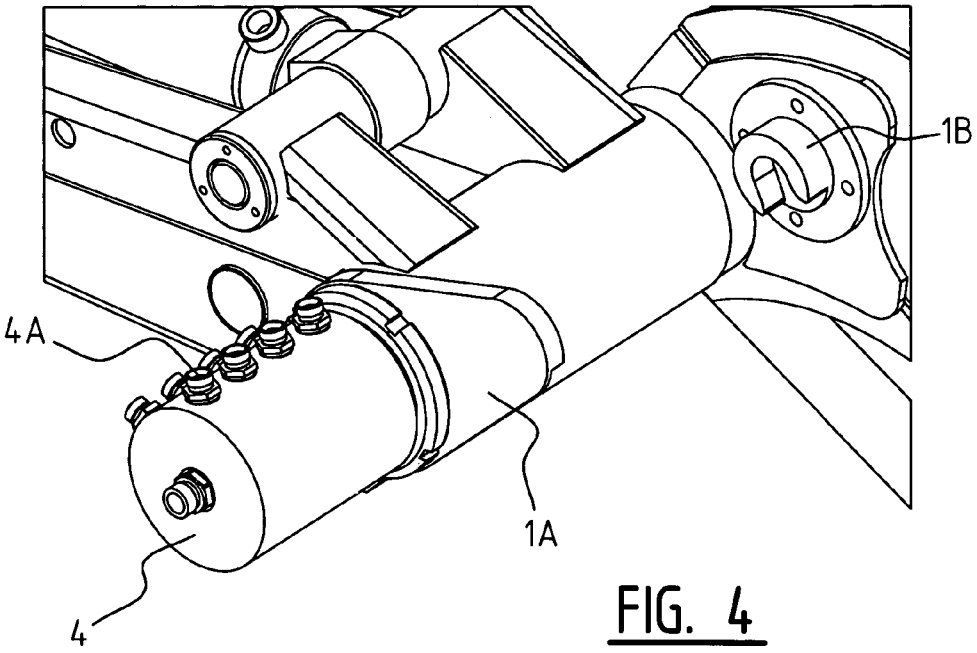
FIGS. 4, 5 and 6 show a further illustration of a swivel joint mechanism and of a mechanical locking system according to embodiments of the present invention from different viewpoints.
Figure 5:
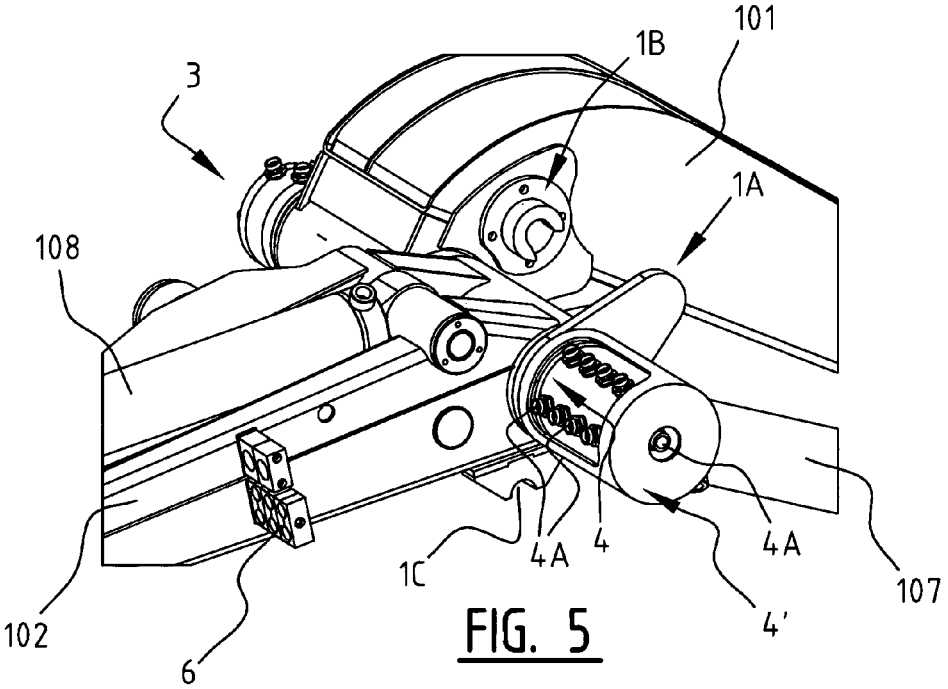
Figure 6:
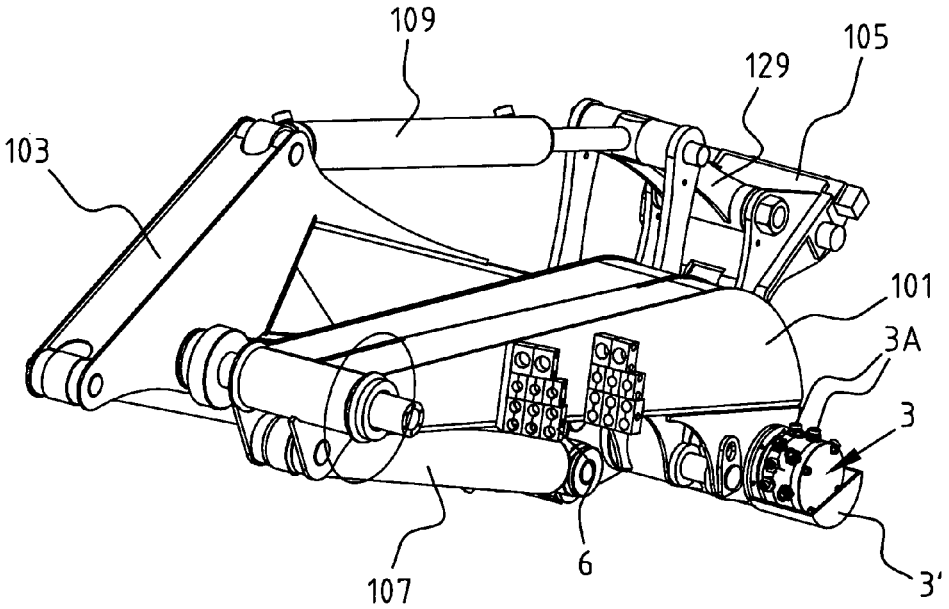

FIG. 4 once again illustrates, from a different viewpoint, the aspects of a mechanical locking and of the swivel joint which is arranged in the substantially hollow shaft. The is also the case for FIG. 5. Also note that guide means 6 can be provided to guide conduits along one or more articulations of the operating arm. FIG. 6 shows a perspective view of the first articulation and other parts. A protruding part of swivel joint 3, which comprises coupling means 3A for conduits, is here also further protected by a protective cover 3'.

Figure 7:
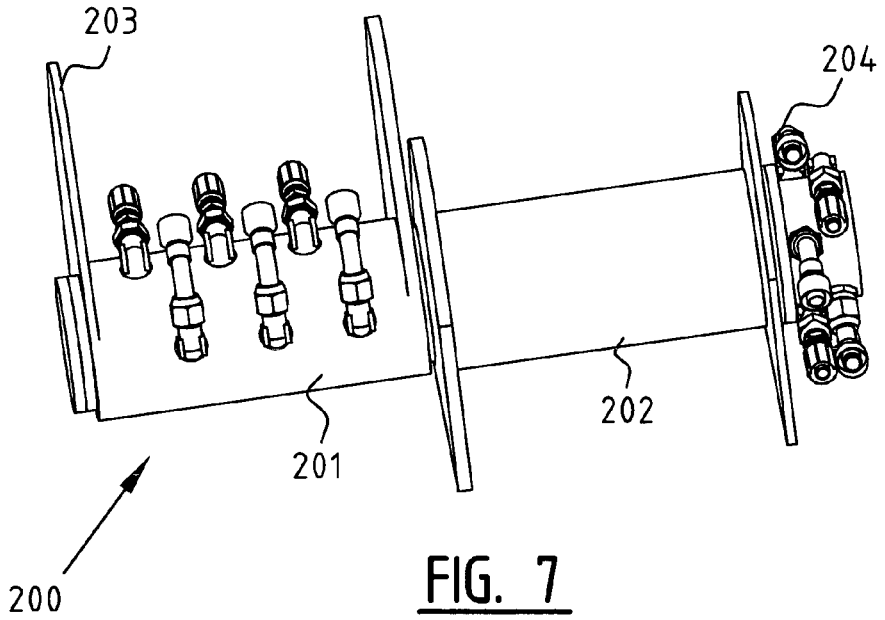
FIG. 7 is a perspective view of an embodiment of a swivel joint which can be used between two articulations.
Figure 8:
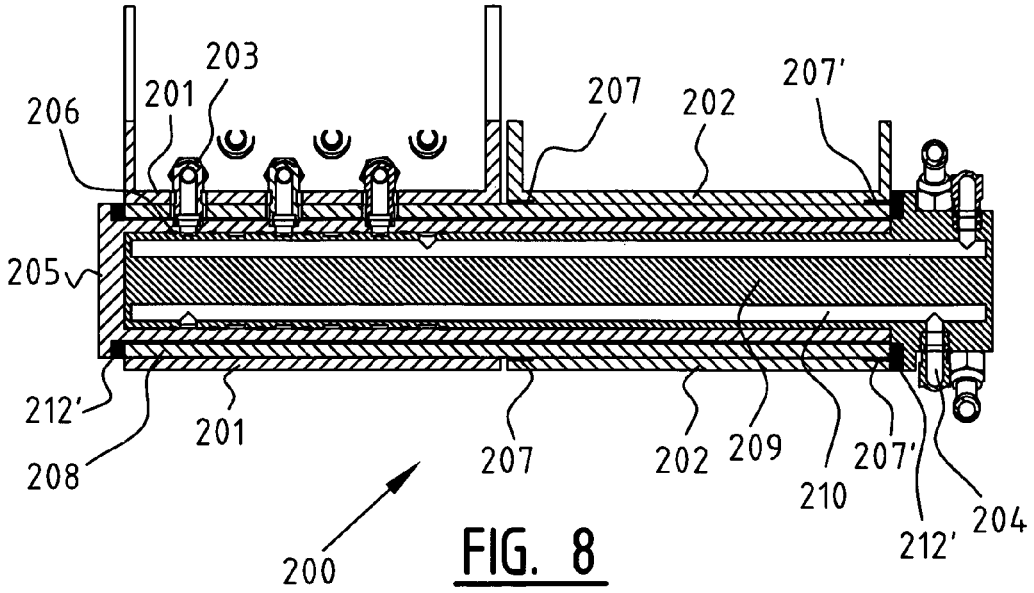
FIG. 8 illustrates a cross-section of the embodiment shown in FIG. 7.

An embodiment of a swivel joint is illustrated in detail in FIGS. 7 and 8. Swivel joint 200 comprises a first element 201, for instance for connection to a first articulation, and a second element 202, for instance for connection to a second articulation.

As can best be seen in the cross-section of FIG. 8, swivel joint 200 comprises a flexible suspension 212 and 212' of a shaft 209 and associated outer sleeve 205 of the swivel joint. Note that this shaft 209 does not absorb any forces. A hollow support shaft 208 supports the swivel joint with outer sleeve 205 and a shaft 209 via flexible suspensions 212 and 212'. First element 201 is connected to this support shaft 208. Second element 202 is mounted rotatably relative to support shaft 208 via bearings 207 and 207'. Hose coupling 204 is provided at the outer end of shaft 209. A hose coupling 203 through first element 201 further runs through support shaft 208 and hose coupling 203 is attached here to outer sleeve 205 so that the fluid can flow via outer sleeve 205 into a fluid channel 210 in shaft 209. At the outer end of shaft 209 the fluid arrives here at hose coupling 204. A plurality of fluid conduits are typically fed through rotatably in the different fluid channels and hose couplings in FIG. 8. Flow in two directions to the sides of each channel is possible here.

The present invention is of course not limited to the above described exemplary embodiments, and the person with ordinary skill in the art will appreciate that many other variants can be envisaged which fall within the scope of the invention, this scope being defined solely by the following claims.

The invention claimed is:

1. An articulated operating arm on which one or more implements are or can be mounted, comprising substantially three articulations which are pivotally connected to each other, which substantially three articulations comprise a first articulation configured for attachment to a construction machine or ship, a second articulation and a third articulation which is configured for connection to the one or more implements, which second articulation is pivotally connected at a first end to the first articulation and at a second end to the third articulation, wherein the substantially three articulations are rotatable adjacently to each other in order to form a shortened arm, such that during the rotation of the articulations, a mechanical locking of the third articulation occurs between the second and the first articulations;

wherein the third articulation and the second articulation each respectively comprise a third and a second coupling means and these are arranged such that when the third and the second articulation rotate adjacently to each other, a mechanical locking of the third articulation occurs relative to the second articulation by coupling between the third coupling means and the second coupling means;

wherein the first articulation comprises a first coupling means which is arranged for the purpose of coupling, after further rotation of the second articulation together with the third articulation to the first articulation, to the third coupling means.

2. The articulated operating arm as claimed in claim 1, further comprising a number of control members for controlling the movements of the substantially three articulations; and a number of conduits for powering the number of control members and, if necessary, the one or more implements, wherein the substantially three articulations comprise a subsequent articulation and a preceding articulation which are adjacent to each other, wherein the subsequent and the preceding articulation are connected by a substantially hollow shaft through which at least one of the number of conduits runs.

3. The articulated operating arm as claimed in claim 1, wherein the third articulation has a first end configured for connection to an implement, wherein the third coupling means is located at the first end of the third articulation, and that the second coupling means is located at the first end of the second articulation.

4. The articulated operating arm as claimed in claim 1, wherein the third coupling means comprises one or more pin structures and that the second coupling means comprises receiving parts for receiving the one or more pin structures.

5. The articulated operating arm as claimed in claim 1, wherein the third articulation of the operating arm has a greater length than the second, such that when the third, second and first articulations are folded against each other a single operating arm can be realized and the attached implement can be freely used at the free end of the third articulation.

6. The articulated operating arm as claimed in claim 1, wherein the first articulation has a first end configured for connection to a sub-frame of a mobile device and a second end connected to the second articulation, wherein the first coupling means is located at the second end of the first articulation.

7. The articulated operating arm as claimed in claim 1, wherein the first and/or the second coupling means comprise recesses which are tapering, and that the coupling means of the third articulation comprises one or more pin structures, wherein the tapering recesses are adapted to receive the one or more pin structures.

8. The articulated operating arm as claimed in claim 1, wherein the first and/or second coupling means partially or wholly comprise of an elastic material such as rubber or plastic.

9. The articulated operating arm as claimed in claim 1, wherein the first and/or second coupling means are spring-mounted by one or more springs.

10. The articulated operating arm as claimed in claim 1, wherein the first and/or second coupling means comprise recesses and that the coupling means of the third articulation comprises one or more pin structures, wherein the recesses are adapted to clampingly receive the one or more pin structures.

* * * * *